United States Patent [19]

Weidlich

[11] 4,044,081

[45] Aug. 23, 1977

[54] DEVICE IN CARBURETTORS, PARTICULARLY FOR INTERNAL COMBUSTION ENGINES

[76] Inventor: Franz Weidlich, Snapphanevagen 150, 175 34 Jarfalla, Sweden

[21] Appl. No.: 654,883

[22] Filed: Feb. 3, 1976

[30] Foreign Application Priority Data

Feb. 6, 1975 Sweden ..... 7501340

[51] Int. Cl.[2] ..... F02M 17/16

[52] U.S. Cl. ..... 261/51; 261/88; 261/89; 239/214.13; 239/214.17; 239/404; 239/427.5; 239/432

[58] Field of Search ..... 261/88, 89, 90, 51, 261/88; 239/214.13, 214.15, 214.17, 214.25, 404, 427.5, 432

[56] References Cited

U.S. PATENT DOCUMENTS

| | | | |
|---|---|---|---|
| 572,176 | 12/1896 | Patterson | 261/88 |
| 1,098,389 | 6/1914 | Lister | 261/88 |
| 1,363,860 | 12/1920 | Fetters et al. | 261/88 |
| 1,551,239 | 8/1925 | Desch | 261/88 |
| 1,746,439 | 2/1930 | Murrer | 261/89 |
| 1,853,682 | 4/1932 | Hechenbleikner | 239/214.15 |
| 1,886,989 | 11/1932 | Trumble | 261/DIG. 51 |
| 1,998,784 | 4/1935 | Mock | 261/DIG. 51 |
| 2,004,840 | 6/1935 | Van Suchtelen | 261/88 |
| 2,273,835 | 2/1942 | Cornell | 261/88 |
| 2,284,195 | 5/1942 | Goodman et al. | 261/89 |
| 2,668,698 | 2/1954 | Rollins | 261/88 |
| 2,998,230 | 8/1961 | Perretti | 261/88 |
| 3,506,198 | 4/1970 | VenDerZwaal | 239/432 |
| 3,738,342 | 6/1973 | Lewakowski | 123/119 A |
| 3,744,773 | 7/1973 | Velander | 261/88 |
| 3,946,552 | 3/1976 | Weinstein et al. | 239/404 |

FOREIGN PATENT DOCUMENTS

| | | | |
|---|---|---|---|
| 283,975 | 12/1928 | United Kingdom | 261/89 |

*Primary Examiner*—Tim R. Miles
*Attorney, Agent, or Firm*—Kurt Kelman

[57] ABSTRACT

An atomized fuel-air mixture is obtained in a heart-shaped chamber of a rotating member which is mounted in the combustion air inlet duct of an internal combustion engine. Fuel and a gaseous medium are injected into the chamber and are thoroughly mixed by a fuel flow dividing portion formed by the curved walls of the chamber in axial alignment with the fuel injection nozzle, which deflects the fuel flow from the axis of rotation towards the periphery of the chamber. Outlet channels exhaust the fuel-gaseous medium mixture from the chamber and impart a rotational force to the member.

8 Claims, 5 Drawing Figures

DEVICE IN CARBURETTORS, PARTICULARLY FOR INTERNAL COMBUSTION ENGINES

The present invention refers to a device in carburettors, particularly for internal combustion engines.

It has been previously proposed to insert a rotating means in the induction duct of an internal combustion engine, e.g. a propeller, to provide further fine division of fuel particles which are possibly present in drop form. There have also been proposed such solutions where fuel is supplied centrally to the hub of a propeller means and by centrifugal force is caused to flow out turbulently in the duct carrying the fuel-air mixture. Such a solution is very advantageous, especially when idling or slow running internal combustion engines.

With the above-mentioned types of carburettor devices, fine division of the fuel indeed does occur, but disadvantages such as an excessive cooling-down of the combustion air arise, and also a certain amount of flow resistance. Ideal for a fuel-air mixture is that the fuel is supplied in as gaseous a state as possible to obtain the most effective combustion possible. To achieve this, the fuel drops must already be finely divided before entrance into the fuel-air mixing duct, preferably by turbulent mixing with a gas. The present invention relates to a solution of the problem in question, which, apart from fine division, also provides other advantages associated with carburettor technology.

A device according to the present invention, in carburettors particularly for internal combustion engines, consists of a rotatable means inserted in a combustion air duct, there being arranged a fuel supply to an inner central portion of the means, which is provided with one or more outlet ducts, and is mainly characterized by the said inner central portion of the means being formed as a chamber with curved wall surfaces, that a gaseous medium is arranged for supply to said inner central portion and that the gaseous medium and fuel is arranged to follow these walls for turbulent mixture with each other before flowing out through the outlet ducts, which are so arranged that the means is supplied with a rotation force through the effect of reaction.

The fuel is preferably arranged for supply through a centrally placed jet portion substantially orientated in the longitudinal direction of the means, and directed towards a flow dividing portion for deflecting along curved surfaces merging into curved surfaces adjacent outlet openings for the gaseous medium. The rotatable means is suitably provided with propeller blades or the like. Further distinguishing features of the invention will be apparent from the following description and reference to the attached drawings.

The drawings show embodiments of the invention.

Figure 1:
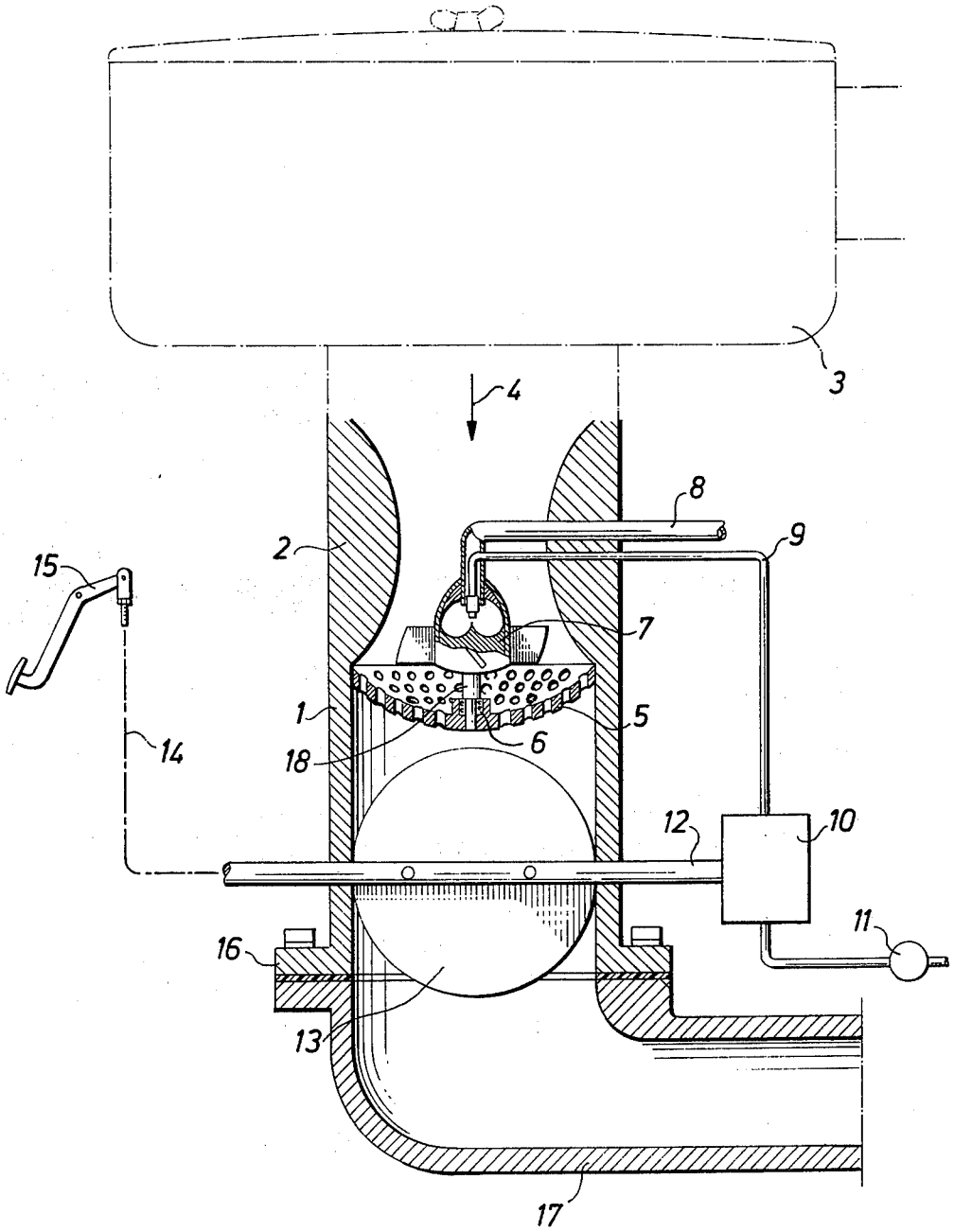
FIG. 1 shows, partially sectioned, a fuel-air duct leading to an internal combustion engine, said duct comprising an embodiment of the present invention, this also shown partly in section.

The duct 1, carrying air and fuel-air mixture is provided with a venturi part 2 in the usual manner, above which there is indicated by chain dotted lines an air filter 3 for the combustion air. Air is arranged to flow in the direction of the arrow 4. Downstream of the venturi part 2 there is mounted a cupshaped strainerlike device 5, which by means of a bearing 6 centrally carries a propeller means generally denoted by the numeral 17. The latter means will be described more closely while referring to FIG. 2. A gas or air canal 8 and a fuel canal 9 are led to the propeller means. The latter canal is in communication with a fuel flow regulator 10, to which fuel is pumped by means of a pump 11. The control means of the fuel flow regulator are connected by a shaft 12 carrying a throttle 13 for regulating the flow of gas in the duct 1. In the prevailing fashion, the shaft 12 is connected to an engine regulating pedal 15, usually called an accelerator pedal, by a linkage system represented here by a chain line 14. The tubular duct 1 is connected downstream of throttle 13, and by a flange connection 16, to the induction pipe 17 of an induction manifold (not shown) in an internal combustion engine.

Figure 2:
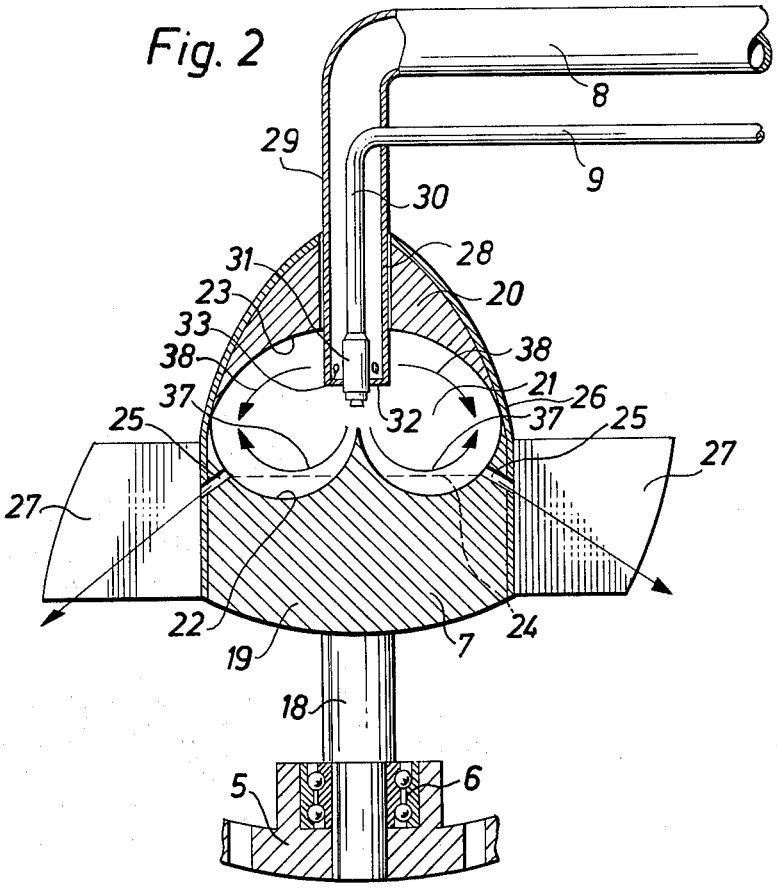
FIG. 2 shows in section and to an enlarged scale the embodiment according to FIG. 1.

As may be seen from FIG. 2, the ball bearing 6 arranged in the strainer means 5 carries a shaft 18 for the propeller means 7. The propeller means in its turn consist of two body portions 19,20, together defining a chamber 21 with lower curved wall portions 22 associated with body portion 19 and upper curved wall portions 23 associated with body portion 20. At the junction 24 between the body portions there are peripherally arranged, at an angle in relation to the radial direction, jet-like outlet openings 25, opening out through a shell 26 attached to the upper body portion 20 and stretching down over the cylindrical portions of the lower body portion 19. Propeller blades 27 are attached to said shell.

Figure 3:
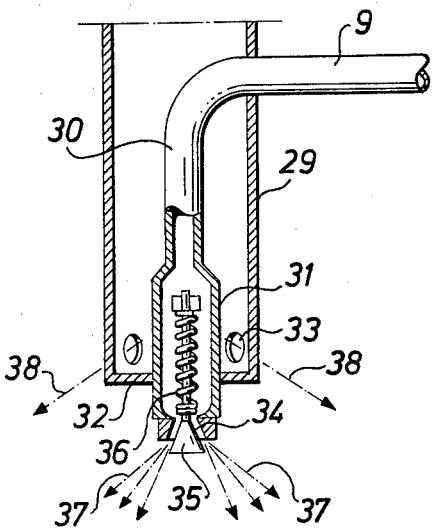
FIG. 3 shows a detail of FIG. 2, to a further enlarged scale and partly in section.

Through the upper body portion 20 and the shell 26 a hole 28 is made, through which an end portion 29 of the pipe 8 extends. Through said end portion 29 there centrally extends a portion 30 of the pipe 9 which opens out into a jet portion 31. The free end of the pipe portion 29 terminates tightly around the jet portion 31 by means of an end plate 32. In said pipe portion 29 holes 33 in the cylindrical surface of the pipe are taken up adjacent the end plate 32. As is more closely appreciated from FIG. 3, the jet portion consists of a spreader means 35 arranged in an end opening 34, the spreader means being actuated in a direction closing the opening 34 by means of a helical spring 36. As may be seen from FIG. 3 the means 35 is conical, as are the engaging wall surfaces in the opening 34. The means 35 opens more to a greater or less extent in response to the flow in the pipe 9,30.

The device functions in the following manner. It is assumed that the accelerator pedal 15 is actuated so that the throttle 13 assumes an open position to allow through an air-fuel mixture from the ducts 1,17 in question, the fuel flow through the pipe 9 being hereby increased because of flow variation in the regulator 10, caused by said actuation of the accelerator pedal 15. Fuel will hereby be forced out through the opening 34 and spread in the direction of the arrows 37. From FIG. 2 it is apparent that the fuel will follow the curve of the wall portion 22. Hot air or in appropriate cases, hot exhaust gases by-passed from the engine exhaust ducting are pressed through the pipe 8,29. After passing out through the holes 33 these hot gases will follow the curve of the wall surface 23. The fuel following in the direction of arrows 37 and the hot gases following in the direction of arrows 38 will meet each other and bring about mixing and vaporization under very high turbulence. Through excess pressure in the chamber 21 the hot fuel-gas mixture will be forced out through the jet holes 25, whereat the propeller means 7 increases its speed of rotation already obtained from the air flow, as a result of the reaction effect now arising. The gas flowing out through the holes 25, consisting to a major extent of vaporized fuel, mixes with the combustion air flowing in the direction of the arrow 4 from the air filter 3 and passes hereafter through the strainer means 5 at great speed, past the throttle 13 and in through the duct 17 to the valve chambers. By conduction from the hot parts of the engine, a certain amount of heat will be transferred to the strainer means 5, which thereby also contributes to homogenizing the fuel-air mixture passing through the duct formed by the ducts 1,17.

Practical experiments have shown that the gas flowing out through the holes 25 in the propeller means 7 does not contain any drop-like portions of the fuel which was supplied through the pipe 9,30 at all. By means of the extremely effective turbulent contact between hot gases and fuel in the rapidly revolving chamber 21, the sought-after vaporization of the fuel is easily obtained, simultaneously as an extremely effective mixture with the combustion air is achieved by rotation of the valve means in the air stream. By means of the arrangement shown, a fuel supply is obtained to the device which is in proportion to the actuation of the accelerator pedal 15, and thus in proportion to the engine power desired to be utilized in appropriate cases. It should be pointed out in this connection that both the flow regulator 10 and the fuel pump 11 constitute compenents known per se, as well as the connection to throttle and accelerator pedal. The propeller means which, because of the fuel gases flowing out, will be self-driven, will, under certain running conditions, substantially function as a compressor for the fuel-gas mixture. This results in that in transition, for example, from high revolutions to low revolutions in the engine, the kinetic energy of the propeller keeps the rotation going and concentrates a certain amount of fuel gas in the ducts to the valves. In its turn this causes, during a subsequent acceleration, a high gas concentration to be present in said ducts, which efficiently contributes to the power increase required during acceleration without liquid fuel particles coming into the system, which is usual with current carburettors in corresponding acceleration conditions. Extremely favourable and clean combustion is thus obtained by the device according to the present invention.

Figure 4:
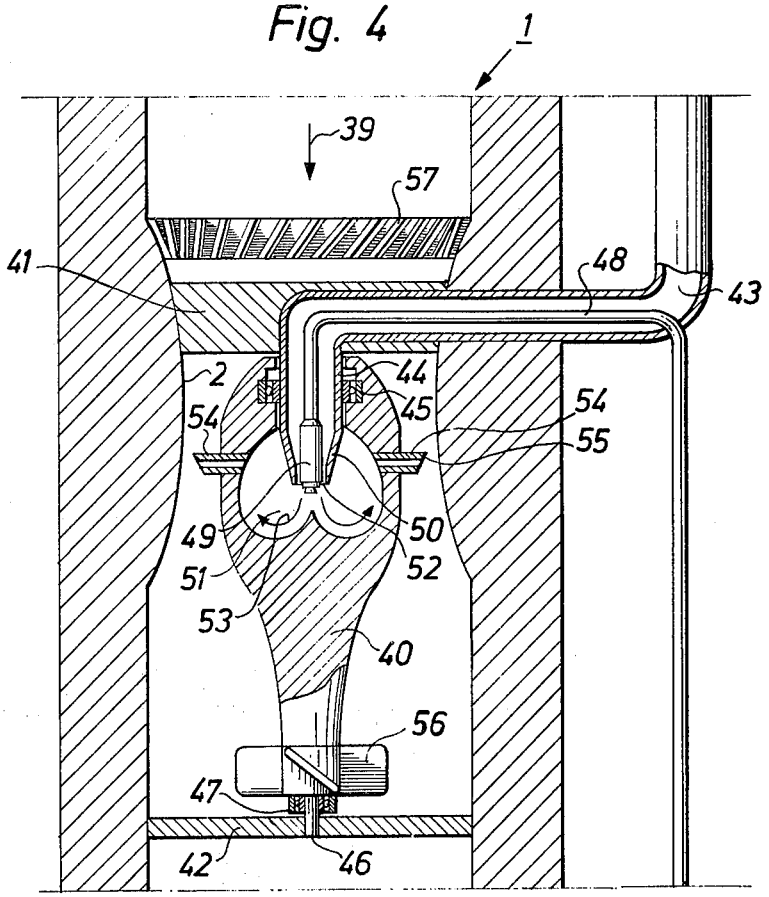
FIG. 4 shows a further embodiment of the invention in a longitudinal section.
Figure 5:
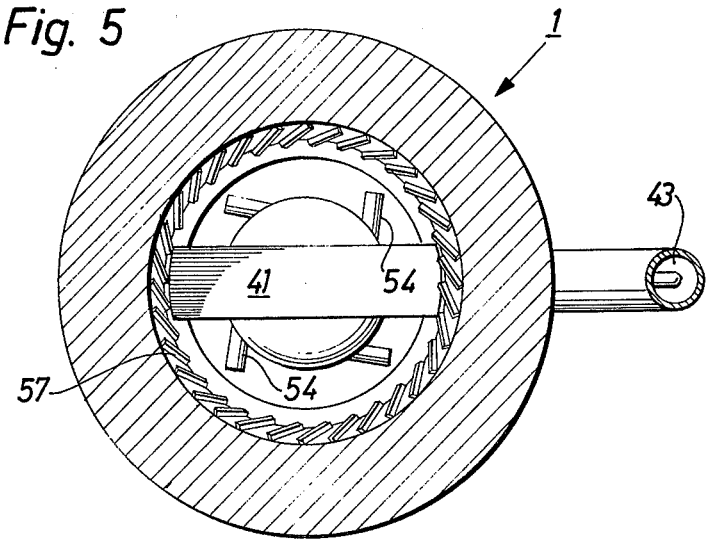
FIG. 5 shows the embodiment according to FIG. 4, seen from the upstream end in relation to the direction of flow of the fuel-air mixture.

The embodiment shown in FIGS. 4 and 5 is contained in a duct 1 with a venturi portion 2 as in the embodiment shown in FIG. 1. In the latter figure, for simplicity in demonstration, neither the air cleaner 3 or the gas regulation means 10–15 or connecting ducts 16,17 are shown. The air from the filter 3 is assumed to flow in the direction of arrow 39 through the duct 1 towards the venturi portion 2. The embodiment according to FIG. 4 comprises a rotatable means 40 which is carried by two pieces 41 and 42 extending diametrically between the walls of the tubular duct 1. The piece 41 contains a pipe 43 extending through the wall in the tubular duct 1 and the piece to bend downwards out of the piece in the middle thereof and into the interior of the rotating means 40. The portion 44 of the pipe projecting out of the piece 41 simultaneously constitutes a journalling pin for a ball bearing 45, the outer ring of which is attached to the rotatable means 40. The portion 44 and the bearing 45 thereby constitute one of the mounting points of the rotatable means 40. The other mounting point for the rotatable means 40 is situated centrally in the piece 42 and consists of a pin 46 coacting with a ball bearing 47, mounted in the appropriate end of the rotatable means.

In the pipe 43 there is arranged a further pipe 48 accompanying the pipe 43 in its deflection downwards through the portion 44, and terminated by a jet 49. As is apparent in FIG. 4 the outer portion 50 of the pipe portion 44, i.e. the portion opening out into an inner chamber 51 in the rotatable means 40, is made tapering. At the end of the tapering portion 50 there is an annular opening 52 between the cylindrical surface of the jet 49 and the inside surface of the tapering portion 50. In comparing the previous embodiment and the present one, it will be found that the pipe 43 corresponds to the pipe 8, the pipe 48 to the pipe 9 and the jet 49 to the jet portion 31. Furthermore, the chamber 51 is shaped substantially as the chamber 21 in the embodiment according to FIGS. 1–3.

Consequently, the pipe 43 is intended to pass hot gases and the pipe 48 to pass fuel. Taking into account the shape of the tapering portion 50 of the pipe portion 44 the hot gases in this embodiment will flow out around the jet 49 and in the same direction as the fuel coming from the jet 49 as shown by the arrows 53. Fuel and hot gases are indeed not mixed in counterflowing currents, but practical experiments have shown that the turbulent mixture will be completely satisfactory even so. The chamber 51 in the rotatable means 40 is arranged to communicate with the duct 1 by outlet pipes 54 attached to the means 40, the pipes 54 being directed obliquely outward from the rotatable means 40, as is apparent from FIG. 5, so that the fuel gas flowing out provides the rotatable means with a rotational movement. The outer ends 55 of the outlet pipes 54 are obliquely bevelled to prevent the air flowing in the duct 1 from opposing the flow of the gases out of the chamber 51. Adjacent to the bearing 47 for the rotatable means 40 there are arranged propeller blades 56 with such an angular disposition that on rotation of the rotatable means through reaction from the gases coming out from the outlet pipe 54 a flow direction is obtained for the fuel-air mixture agreeing with the one according to the arrow 39. The propeller blades 56 can naturally have a counter-directed angular disposition so that on rotation of the means 40 in the way described above, a turbulent zone is formed about the propeller for effectively mixing combustion air and fuel gases. In the last-mentioned embodiment, the propeller will serve as a brake to keep the speed of the rotating means 40 within reasonable limits for high flow speeds in the outgoing fuel gases from the outlet pipes 54. The size of the propeller blades 56 can naturally be adjusted in response to desired running conditions, so that desired flowng conditions for the fuel-air mixture are present.

To achieve a turbulent zone around the rotating means 40 there is arranged above the piece 41 a wreath of guiding fins 57 around the inside wall of the duct 1 and the venturi portion 2. It should be noted that said guiding fins force the combustion air to circulate in a direction opposite to the rotational direction of the means 40 and thereby the direction of the propeller blades 56. There is obtained hereby an extremely effective turbulent mixture of fuel gases and combustion air, simultaneously as an effective speed regulation of the rotatable means is obtained by the effect on the propeller blades of the rotating air stream, during high flow speeds of the combustion air.

In FIG. 4 and 5 there is shown an arrangement of the guiding fins upstream of the rotatable means 40, but naturally such guiding fins can be arranged about the rotatable means or about the propeller portion thereof.

Within the scope of the present invention it is naturally possible to make the devices so that fuel through the pipe 9 or pipe 48 is supplied in a way other than by the flow regulating means 10 shown, e.g. via a floatcontrolled container similar to what is to be found in current carburettor devices. It is naturally not necessary to supply hot air or hot gases through the pipe 8 or the pipe 43, but for certain running conditions it may be conceivable to supply ordinary air at outside temperature through said piping, either directly or via a fan or compressor device. The best result is naturally obtained if hot gases such as gases bypassed from the engine or heated air are taken to the pipe 43. The jet portion 31 or the jet 49 can naturally be made in many different ways, but the embodiment shown is extremely suitable in the present case. The shape of the chamber 21 and the chamber 51 can naturally diverge from what is shown. What is essential, however, is that outflowing fuel and gas are mixed with each other in turbulent conditions. It is evident that both guiding fins and grooves can be arranged in the inner walls of the chambers 21 and 51 to provide further turbulent effect. The direction of the channels 25 and the outlet pipes 54 can also be adjusted to current running conditions with regard to direction in relation to the flowing combustion air, and the dynamic working conditions of the propellers in question. In the embodiment according to FIGS. 1–3 it is possible to arrange the propeller means on a frame in the pipe 1 and not as shown on a dished strainer means 5. The fuel supplied may be a gas. Such a design wherein the rotatable means 7 or 40 lack a propeller blade are also conceivable.

I claim:

1. A carburetor device for an internal combustion engine having a combustion air inlet duct, which comprises a. a rotatable member mounted for rotation in the inlet duct about the axis thereof, the rotatable member defining 1. a substantially heart-shaped interior chamber, b. means for supplying fuel under pressure to the interior chamber, the fuel supplying means including 1. an axially extending jet portion mounted centrally in the interior chamber for ejecting the fuel thereinto, c. means for supplying a gaseous medium under pressure to the interior chamber whereby the gaseous medium is mixed with the fuel therein, 1. curved surfaces in the interior of the rotatable member defining the heart-shaped interior chamber and merging in axial alignment with the jet portion into a fuel flow dividing portion for deflecting the fuel flow from the axis of rotation towards the periphery of the chamber, and d. outlet channels in the rotatable member in communication with the periphery of the interior chamber for exhausting the fuel-gaseous-medium mixture therefrom, the outlet channels being arranged to impart a rotational force to the rotatable member.

2. The carburetor of claim 1, wherein the means for supplying the gaseous medium defines outlet openings directing the outflow of the gaseous medium into the interior chamber in a direction substantially transverse to the axis of rotation, upper ones of the curved surfaces deflecting the gaseous medium flow downwardly from the outlet openings towards the chamber periphery and lower ones of the curved surfaces deflecting the fuel flow upwardly into contact with the gaseous medium for turbulent mixture of the fuel and gaseous medium in the chamber.

3. The carburetor of claim 2, wherein the rotatable member is comprised of two body halves, one of the body halves defining the upper curved surfaces and the other body half defining the lower curved surfaces, and a shell holding the two body halves assembled to define the interior chamber therebetween.

4. The carburetor of claim 2, further comprising propeller blades mounted on the rotatable member, the outlet channels being arranged to exhaust the fuel-gaseous medium mixture between the propeller blades.

5. The carburetor of claim 1, wherein the means for supplying the gaseous medium is a pipe having an end portion extending in the inlet duct axis and leading into the interior chamber, and the means for supplying the fuel is a pipe having an end portion including the jet portion mounted coaxially within the end portion of the gaseous medium supply pipe and leading into the interior chamber, the end portions of the pipes being arranged upstream of the interior chamber in relation to the direction of air flow in the combustion air inlet duct.

6. The carburetor of claim 5, further comprising a bearing means for the rotatable member on the end portion of the gaseous medium supply pipe for rotatably mounting the rotatable member on the pipe end portion.

7. The carburetor of claim 6, comprising a further bearing means for the rotatable member supported in the inlet duct downstream in relation thereto.

8. The carburetor of claim 6, further comprising propeller blades mounted on the rotatable member adjacent a downstream end thereof.

* * * * *